United States Patent [19]

Dutt

[11] Patent Number: 4,917,253

[45] Date of Patent: Apr. 17, 1990

[54] CONTAINER-CLOSURE WITH FOLD OVER PROJECTIONS

[75] Inventor: Herbert V. Dutt, Sarasota, Fla.

[73] Assignee: Continental Plastics, Inc., Triadelphia, W. Va.

[21] Appl. No.: 330,648

[22] Filed: Mar. 30, 1989

[51] Int. Cl.[4] ..... B67D 3/00

[52] U.S. Cl. ..... 215/235; 220/335; 222/517

[58] Field of Search ..... 222/517; 220/335; 215/235

[56] References Cited

U.S. PATENT DOCUMENTS

| | | | |
|---|---|---|---|
| 3,752,371 | 8/1973 | Suzuki et al. | 222/517 X |
| 4,010,875 | 3/1977 | Babiol | 222/517 |
| 4,158,902 | 6/1979 | Chernack et al. | 220/335 X |
| 4,193,519 | 3/1980 | Dubach et al. | 222/517 X |
| 4,220,248 | 9/1980 | Wilson et al. | 215/235 |
| 4,261,486 | 4/1981 | Bush et al. | 222/517 |
| 4,399,928 | 8/1983 | Klingler | 220/335 |
| 4,625,898 | 12/1986 | Hazard | 220/517 |
| 4,711,360 | 12/1987 | Ullman | 215/235 |

*Primary Examiner*—Donald F. Norton
*Attorney, Agent, or Firm*—Richard V. Westerhoff

[57] ABSTRACT

A closure system for a container having a closure body with a hingedly connected closure lid. The closure body has an end wall and a cylindrical skirt with internal threads for screwing the closure system onto the container. The closure lid has at least one integrally molded projection extending from its cylindrical skirt. The projection engages the closure body end wall when it is desired to dispense material from the container. This projection is rigid enough to prevent the closure lid from interfering with the dispensing of the materials from the container yet is resilient enough to fold under the closure lid when the closure system is in the closed mode.

21 Claims, 3 Drawing Sheets

CONTAINER-CLOSURE WITH FOLD OVER PROJECTIONS

BACKGROUND OF THE INVENTION

1. Field Of The Invention

This invention relates to a closure system for a container having a closure body with a dispensing opening and a closure lid, the closure lid having axially extending projections which prevent the closure lid from moving towards the closure body dispensing opening during dispensing of the contents of the container. More particularly, the closure lid projections engage the end wall of the closure body during the dispensing mode but are resilient enough to fold under the closure lid when it is desired to close the closure system.

2. Description Of The Prior Art

One piece molded closure systems for containers are known in the art. These closure systems typically consist of a closure body having internal threads which is screwed on to the neck of a container and a closure lid which is hingedly connected to the closure body. See, for example, U.S. Pat. Nos. 4,010,875, 4,158,902, and 4,625,898.

It is also known to provide closure systems which prevent the closure lid from moving towards the closure body dispensing opening during dispensing of the contents of the container. U.S. Pat. No. 4,711,360 discloses a closure system in which a cap-stopping resilient integral post projecting upwardly from the closure body near the hinge bears against an inclined portion of the closed upper wall of the cap. This post is said to prevent inadvertent blocking of a dispensing aperture in the closure body during dispensing of material from the container.

U.S. Pat. No. 4,193,519 discloses, in FIG. 2, a closure which includes a spring rod on a cap which engages a second spring rod on the closure body to urge the cap to an open position.

U.S. Pat. No. 4,261,486 discloses a closure system which includes at least one projection on each of the closure body and the closure lid. The projections are equidistantly spaced on opposite sides of the hinge line and are said to be sized to engage each other to prevent the lid from obstructing flow from the dispensing opening. Upon closing the closure system, the projections frictionally engage one another along overlapping sides.

There remains a need for a reliable, inexpensive and easily manufactured closure having a lid that does not interfere with the dispensing of the contents of the container.

There remains a need for the above closure system to be designed so that it can be integrally molded without the need for slides or other complex molding techniques.

There remains a need for the above closure system to fit many different types of closure body dispensing openings.

SUMMARY OF THE INVENTION

These and other needs are satisfied by the invention which is directed toward a closure system including a closure body having a dispensing opening and engagement means securing the container body to a container, and a closure lid having at least one axially extending projection which prevents the closure lid from moving towards the closure body dispensing opening during dispensing of the contents from the container. The projections engage the end wall of the closure body during the dispensing mode but are resilient enough to fold under the closure lid when it is desired to close the closure system. The closure system can be molded as one piece and can be molded without the need for slides or other complex molding techniques.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
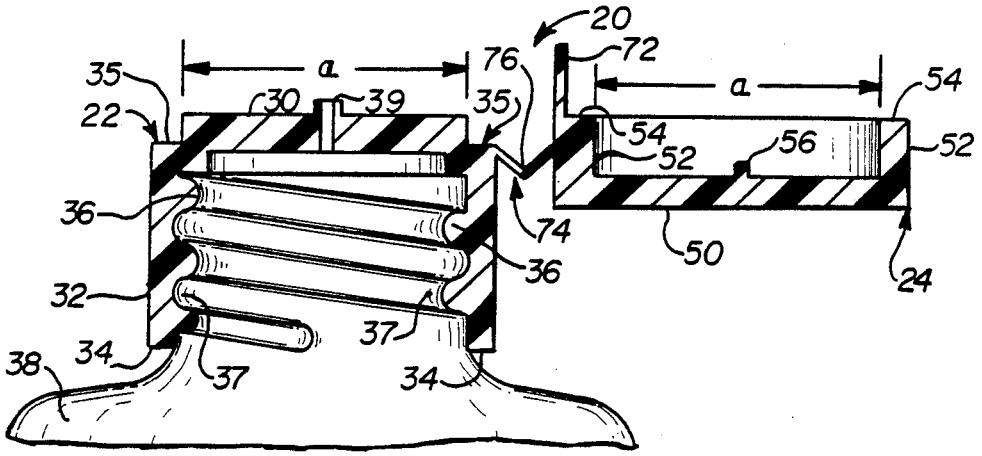
FIG. 1 is a partially cut away side elevational view of the closure system.
Figure 2:
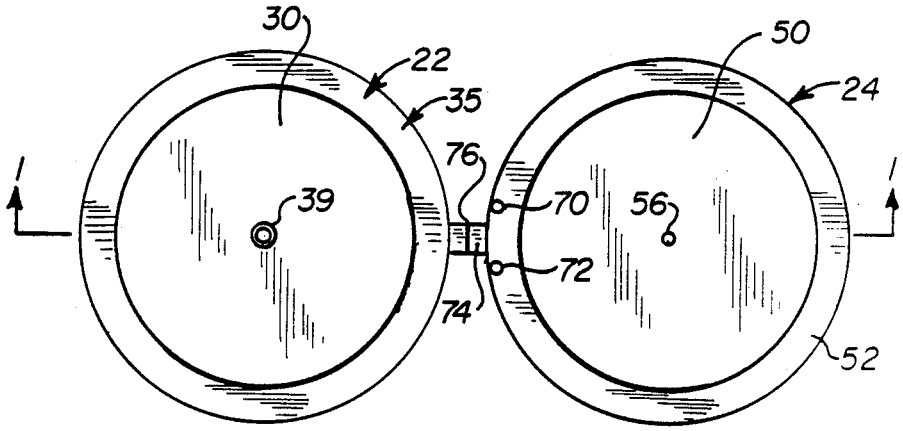
FIG. 2 is a top plan view of the closure system of FIG. 1.

Referring to FIGS. 1 and 2, the closure system 20 of the invention includes a closure body 22 and a closure lid 24. The closure system 20 can be made from any suitable thermoplastic materials such as materials selected from the group consisting of polyethylene terephalate (PET), polyvinyl chloride, polypropylene, high density polyethylene, and low density polyethylene.

The closure body 22 has an end wall 30 and a cylindrical skirt 32 depending from the end wall 30 and terminating in a free end 34. The closure body 22 is also provided with a circumferential shoulder 35 formed on the end wall 30. The skirt 32 is provided with internal threads 36 for engaging external threads 37 on the neck of the container 38. These threads 36 and 37 secure the closure system 20 to the container 38. The end wall 30 has a dispensing opening 39 for allowing the contents of the container 38 to be dispensed therefrom.

The closure lid 24 also includes an end wall 50 and a cylindrical skirt 52 depending from the end wall 50 and terminating in a free end 54. On the underside of the end wall 50 there is a stopper 56 which is designed to fit into the dispensing opening 39 of the closure body 22.

The closure lid 24 also includes a first projection 70 (FIG. 2) and a second projection 72 which are integrally formed with the cylindrical skirt 52. These projections 70 and 72 will be discussed in greater detail with respect to FIGS. 4–6 hereinbelow.

The closure lid 24 and the closure body 22 are joined by a hinge 74. This hinge 74 is integrally molded with the closure lid 24 and closure body 22. The hinge 74 includes a hinge line 76 which allows the closure lid 24 to be folded over to engage the closure body to close the closure system 20 and thus the container 38. Such a "living hinge" is well known in the thermoplastic closure field.

It will be appreciated that in order to provide a tight fitting engagement between the closure lid 24 and closure body 22 that diameter "a" of the end wall 30 between the shoulder portion 35 should be equal to the inner diameter "a" of the end wall 50 of the closure lid 24.

Figure 3:
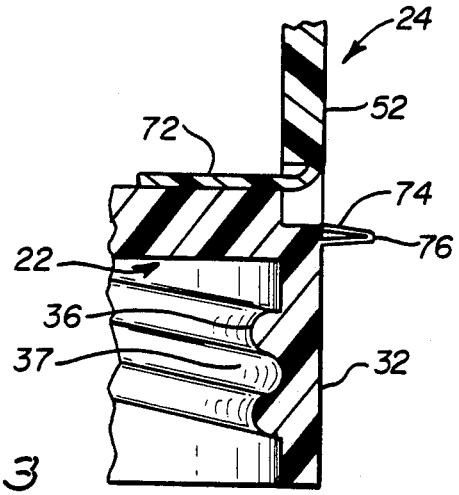
FIG. 3 is a fragmentary side elevational cross-sectional view of the closure system of FIG. 1 in the closed mode.

FIG. 3 shows the closure system in the closed mode. The closure lid 24 is pivoted over on to the closure body 22 so that the projection 72 folds under the closure lid 24. The closure lid cylindrical skirt member 52 snaps over the shoulder portion 35 of the closure lid when the closure is in a closed position to provide a tight fitting engagement between the closure lid and the closure body.

Figure 4:
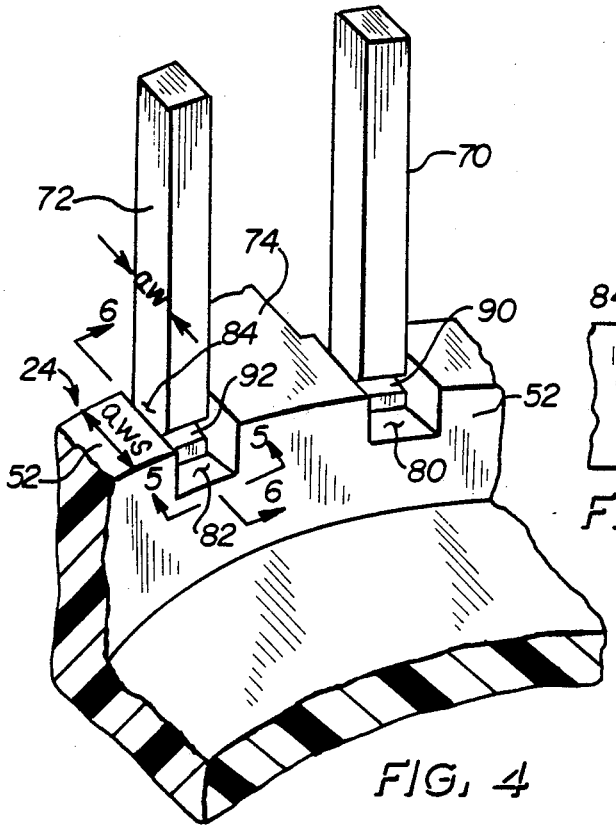
FIG. 4 is an enlarged detailed isometric view of the projections of the closure system of FIG. 1 as formed on the closure lid.
Figure 5:
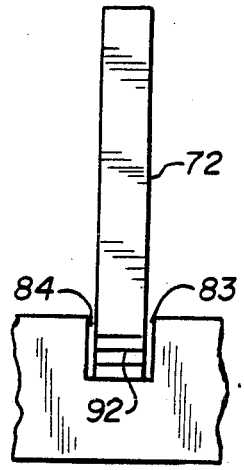
FIG. 5 is a fragmentary elevational view taken along line 5—5 of FIG. 4.
Figure 6:
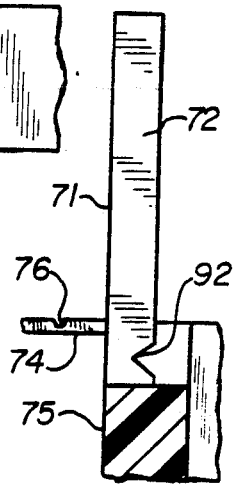
FIG. 6 is a vertical sectional view taken along line 6—6 of FIG. 4.

Referring now to FIGS. 4–6, the projections 70 and 72 will be explained in further detail. FIG. 4 is a greatly enlarged view of the projections 70 and 72 as they are formed in the cylindrical end wall 52 of the closure lid 24. The projections 70 and 72 are preferably rectangular in cross-section and extend a distance of about 0.200 to 0.400 inches with about 0.250 inches being preferred from the free end 54 of the closure lid 24. The projections 70 and 72 preferably have a radial width "aw", that is about 0.020 to 0.040 inches with 0.030 inches being preferred, that is less than the radial width "aws", that is about 0.040 to 0.060 inches with 0.050 inches being preferred, of the skirt. The hinge 74 extends from the closure lid 24 from a position in-between the projections 70 and 72.

It will be appreciated that the closure 20 can be molded in a straight draw two piece mold without the need for slides. This means that the closure can be made efficiently and economically.

The projections 70 and 72 are disposed in respective slots 80 and 82 defined by the closure lid 24. As can be seen in FIG. 5, the projection 72 has clearance grooves 83 and 84 on either side extending radially outward from the slot 82. Thus, the side surfaces of the projections 72 are spaced from the sides of the slot. This is preferred in order to facilitate bending of the projections 70 and 72 when the closure lid 24 is folded over the closure body 22 to close the closure system 20.

As can be appreciated from FIG. 6, the outside surface of the projection 71 is axially aligned with and is a continuation of the outside surface 75 of the closure lid 24. It will be appreciated, however, that this is a preferred embodiment and that the projections can be positioned in different positions relative to the cylindrical skirts (see FIGS. 8–11, for example) and that the projections can have different widths, lengths, and heights.

FIGS. 4–6 also show the optional notches 90 and 92 in the projections 70 and 72. FIG. 6 shows a detailed view of the notch 92 in projection 72. These notches 90 and 92 provide a pivot point in the projections 70 and 72 so as to facilitate bending of the projections 70 and 72 when the closure lid 24 is folded over the closure body 22 to close the closure system 20.

Referring back to FIG. 3, closure system 20 is shown in the closed mode. The closure lid 24 is pivoted on the hinge line 76 of the hinge 74 to a closed mode position. The projection 72 folds under the closure lid 24. The projections 70 and 72 bend independently of the closure lid 24 because of the clearance grooves 83 and 84 on either side of these projections. The projections 70 and 72, when bent, are disposed in the slots 80 and 82 defined in the closure lid cylindrical skirt member.

Figure 7:
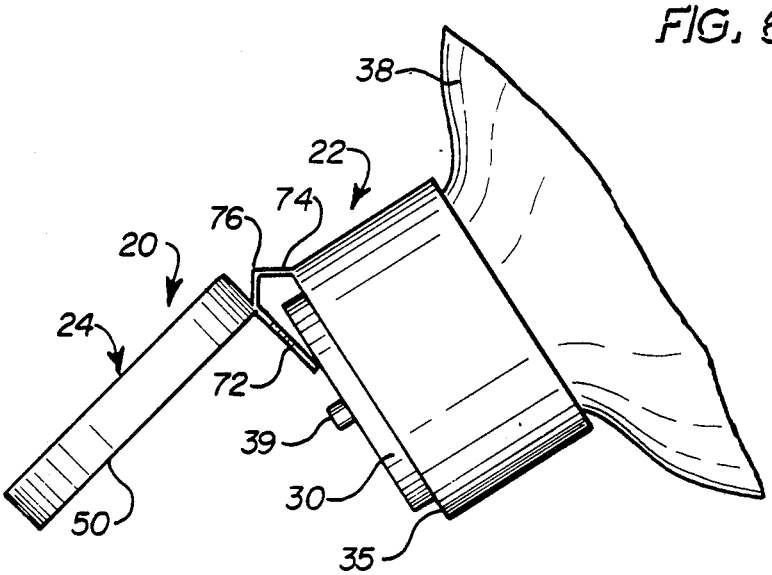
FIG. 7 is a side elevational view of the closure system on a container when the container is used in the dispensing mode.

FIG. 7 shows the closure system in the dispensing mode. When it is desired to dispense the contents of the container 38, the closure lid 24 is merely flipped off of the closure body 22 from the closed mode shown in FIG. 3. The contents of the container are now ready to be dispensed.

The projections 70 and 72 (projection 72 is shown in FIG. 7) bear against the end wall 30 of the closure body 22 so as to prevent the closure lid 24 from interfering with the dispensing of the contents of the container. The projections 70 and 72, therefore, are rigid enough to prevent the closure lid 24 from interfering with the dispensing of the contents of the container yet are resilient enough to fold under the closure lid 24 when it is desired to close the closure.

Figure 8:
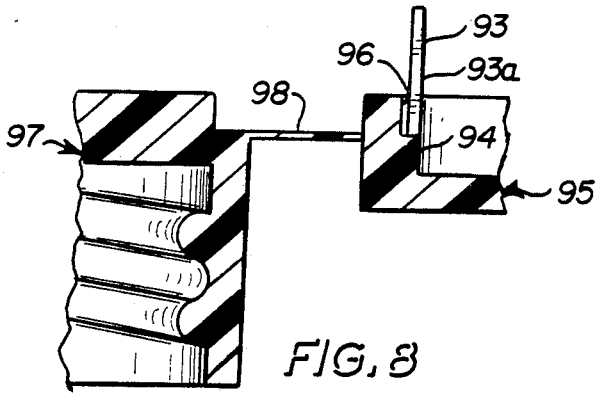
FIG. 8 is a side elevational cross-sectional view of another embodiment of the closure system.
Figure 8A:
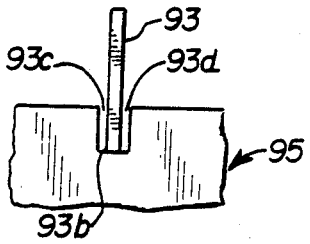
FIG. 8*a* is a fragmentary elevational view of the embodiment shown in FIG. 8.

FIG. 8 shows another embodiment of the invention wherein the projection is positioned so that its inner surface is axially aligned with the inner circumferential surface of the closure lid. The inner surface 93*a* of projection 93 is aligned with inner circumferential surface 94 of the cylindrical skirt of closure lid 95. As with projections 70 and 72, as can be seen in FIG. 8*a*, projection 93 is positioned in a slot 93*b* having side clearance grooves 93*c* and 93*d*. In addition, as can been seen in FIG. 8, there is a circumferential recess 96 defined in the closure lid 95. This recess 96 is preferred in order to facilitate bending of the projection 93 when the closure lid 95 is folded over the closure body 97 by means of the hinge 98 to close this closure system.

Figure 9:
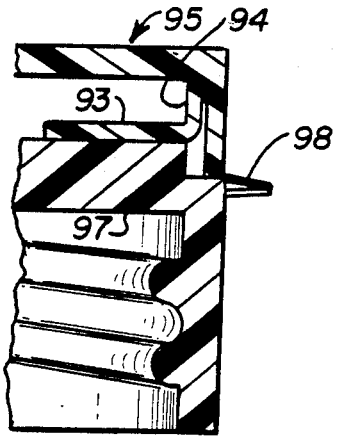
FIG. 9 is a side elevational cross-sectional view of the hinge and closure system of FIG. 8 in the closed mode.

FIG. 9 shows an enlarged side elevational cross-sectional view of the closure of FIGS. 8 and 8*a* in the closed position. The projection 93 is folded under the closure lid 95 and rests on the end wall of the closure body 97.

As can be seen in FIGS. 8 and 9, this embodiment does not include a shoulder portion formed in the end wall. If a shoulder portion was formed in the end wall, the projection 93 would have to extend further axially in the slot 93*b* in order to facilitate the projection 93 contacting the end wall of the closure body 97. It will be appreciated that all embodiments disclosed herein may or may not include this shoulder portion.

Figure 10:
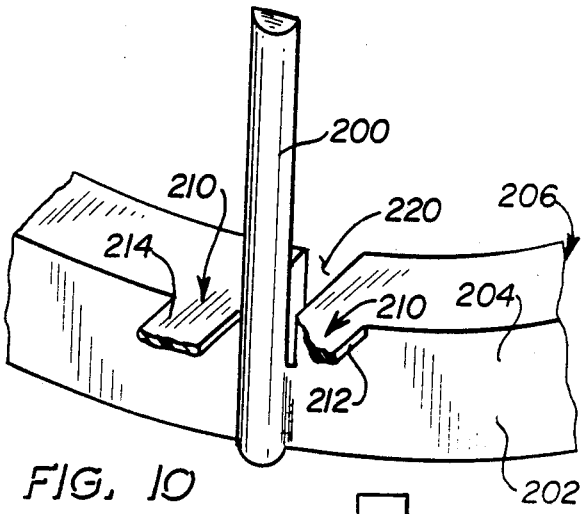
FIG. 10 is an isometric view of yet another embodiment of the invention.

FIG. 10 shows another embodiment of the invention in which the projection is positioned on the outside of the cylindrical skirt. The projection 200 is formed on the outside surface 202 of the cylindrical skirt 204 of the closure lid 206. The hinge 210 is split into two separate parts 212 and 214. The projection 200 is positioned between the two parts 212 and 214 of the hinge 210. When the closure lid 206 is folded over on to the closure body (not shown), the projection 200 folds over into slot 220 in the cylindrical skirt 204 of the closure lid 206. It will be appreciated that in the dispensing mode the projection 200, as do projections 70 and 72, prevents the closure lid 206 from interfering with the dispensing of the contents of the container by engaging the end wall of the closure body (not shown). The projection 200 is rigid enough to prevent interference in the dispensing of the contents from the container but is resilient enough to fold under the closure lid 206 when the closure system is in a closed mode.

Figure 11:
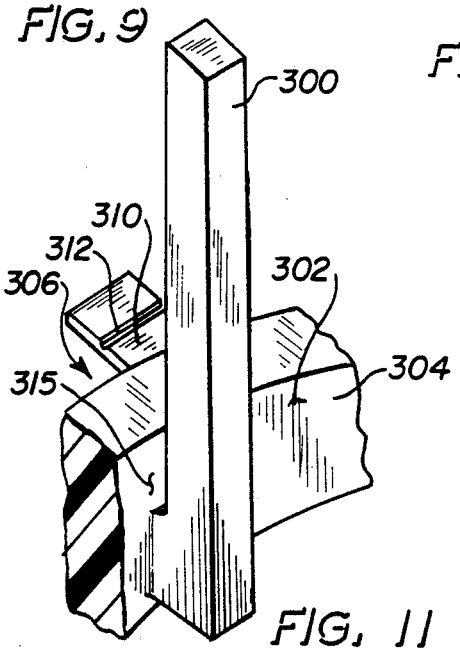
FIG. 11 is an isometric view of still another embodiment of the invention.
Figure 12:
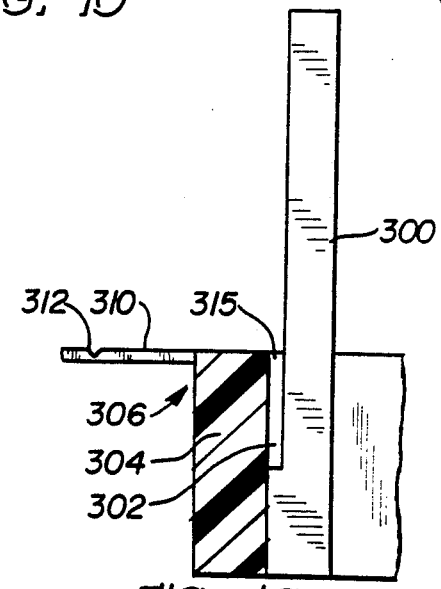
FIG. 12 is a side elevational view of the embodiment shown in FIG. 11.

FIG. 11 illustrates yet another embodiment of the closure system in which the projection 300 is positioned on the inside surface 302 of the cylindrical skirt 304 of the closure lid 306. A living hinge 310 with a score line 312 is provided to allow the closure lid 306 to be folded over on to the closure body (not shown). As can be seen in FIG. 12, there is a space 315 between the inside surface of the cylindrical skirt 304 and the projection 300. This will facilitate bending of the projection 300 when the closure system is in the closed mode. It will be appreciated that in the dispensing mode the projection 300, as do projections 70 and 72, prevents the closure lid 306 from interfering with the dispensing of the contents of the container by engaging the end wall of the closure body (not shown). The projection 300 is rigid enough to prevent interference in the dispensing of the contents from the container but is resilient enough to fold under the closure lid 306 when the closure system is in a closed mode.

While specific embodiments of the invention have been describe in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A closure for a container having a neck with external engagement means for receiving and retaining said closure, said closure comprising:

a closure body having a closure body end wall and a closure body cylindrical skirt member depending from said closure body end wall, said closure body end wall having a dispensing opening and said closure body cylindrical skirt member having internal engagement means complimentary to said external engagement means on the container neck for selectively securing said closure body to said container, a closure lid having a closure lid end wall and a closure lid cylindrical skirt member depending from said closure lid end wall and terminating in a free end, a hinge means pivotally connecting said closure body to said closure lid for movement of said closure lid from an open position in which the contents of said container can be dispensed to a closed position in which the contents of said container cannot escape, and at least one resilient projection extending axially from said free end of said closure lid cylindrical skirt member which contacts said closure body end wall to space said closure lid from said closure body to prevent interference of said closure lid with said closure body while material is being dispensed from said container and which folds over when said closure lid is closed on said closure body.

2. The closure of claim 1, wherein said closure lid cylindrical skirt member has a radial width that is greater than the radial width of said projection.

3. The closure of claim 2, wherein said closure body end wall defines a shoulder portion having an axial height and a radial width and said closure lid free end engages said shoulder portion to form a tight fitting engagement between said closure lid and said closure body.

4. The closure of claim 2, wherein said closure lid cylindrical skirt member defines a slot extending axially from said free end of said closure cylindrical skirt member and radially outward from the inner surface of said closure lid cylindrical skirt member to said projection and through which said projection extends when it is folded over upon closing of said closure and said closure lid cylindrical skirt member further defines grooves extending axially from said free end of said closure lid cylindrical skirt member and radially through said closure lid cylindrical skirt member on each side of said projection.

5. The closure of claim 4, wherein said projection has an outer surface which is axially aligned with and is a continuation of the outer surface of said closure lid cylindrical skirt member.

6. The closure of claim 5, wherein, said closure body end wall defines a shoulder portion having an axial height and a radial width and said closure lid free end engages said shoulder portion to form a tight fitting engagement between said closure lid and said closure body.

7. The closure of claim 6, wherein said projection has a notch at a pivot axis about which said projection bends when said closure lid is closed on said closure body.

8. The closure of claim 6, including a first projection and a second projection both extending from said closure lid skirt member, said hinge means being positioned on said closure lid cylindrical skirt member between said first and second projections.

9. The closure of claim 4, wherein said projection has an inner surface which is axially aligned with and is a continuation of the outer surface of said closure lid cylindrical skirt member.

10. The closure of claim 9, wherein said closure body end wall defines a shoulder portion having an axial height and a radial width and said closure lid free end engages said shoulder portion to form a tight fitting engagement between said closure lid and said closure body.

11. The closure of claim 10, wherein said projection has a notch at a pivot axis about which said projection bends when said closure lid is closed on said closure body.

12. The closure of claim 10, wherein said hinge means consist of a first hinge member and a second hinge member, each connecting said closure body to said closure lid, said projection being positioned between said first and second hinge members.

13. The closure of claim 2, wherein said closure lid cylindrical skirt member defines a slot extending axially from said free end of said closure lid cylindrical skirt member and radially outward from the inner surface of said closure lid cylindrical skirt member and said closure lid cylindrical skirt member further defines grooves extending axially from said free end of said closure lid cylindrical skirt member and radially through said closure lid cylindrical skirt member on three sides of said projection.

14. The closure of claim 13, wherein said projection has an inner surface which is axially aligned with and is a continuation of the inner surface of said closure lid cylindrical skirt member.

15. The closure of claim 14, wherein, said closure body end wall defines a shoulder portion having an axial height and a radial width and said closure lid free end engages said shoulder portion to form a tight fitting engagement between said closure lid and said closure body.

16. The closure claim 15, wherein said projection has a notch at a pivot axis about which said projection bends when said closure lid is closed on said closure body.

17. The closure of claim 15, wherein a first projection and a second projection both extending from said closure lid skirt member, said hinge means being positioned on said closure lid cylindrical skirt member between said first and second projection.

18. The closure of claim 2, wherein said projection has an outer surface which is substantially axially aligned with and is a continuation of the inner surface of said closure lid cylindrical skirt member.

19. The closure of claim 18, wherein, said closure body end wall defines a shoulder portion having an axial height and a radial width and said closure lid free end engaged said shoulder portion to form a tight fitting engagement between said closure lid and said closure body.

20. The closure of claim 19, wherein said projection has a notch at a pivot axis about which said projection bends when said closure lid is closed on said closure body.

21. The closure of claim 19, wherein a first projection and a second projection both extending from said closure lid skirt member, said hinge means being positioned on said closure lid cylindrical skirt member between said first and second projection.

* * * * *